US007049269B2

(12) United States Patent
Hara

(10) Patent No.: US 7,049,269 B2
(45) Date of Patent: May 23, 2006

(54) THERMAL RECORDING MATERIAL AND PRODUCTION METHOD THEREOF

(75) Inventor: Toshio Hara, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 160 days.

(21) Appl. No.: 10/254,547

(22) Filed: Sep. 26, 2002

(65) Prior Publication Data

US 2003/0157427 A1 Aug. 21, 2003

(30) Foreign Application Priority Data

Sep. 27, 2001 (JP) ..... 2001-296511

(51) Int. Cl.
*B41M 5/40* (2006.01)

(52) U.S. Cl. ..... 503/226; 427/150; 427/152; 503/200; 503/214

(58) Field of Classification Search ..... 427/150–152; 503/200, 226, 214
See application file for complete search history.

(56) References Cited

U.S. PATENT DOCUMENTS 4,758,547 A * 7/1988 Itabashi et al. ..... 503/207
5,409,880 A 4/1995 Itabashi et al.
6,150,067 A 11/2000 Koike et al.

FOREIGN PATENT DOCUMENTS

JP 1-257088 A 10/1989

* cited by examiner

*Primary Examiner*—Bruce H. Hess
(74) *Attorney, Agent, or Firm*—Sughrue Mion, PLLC

(57) ABSTRACT

The present invention provides a thermal recording material comprising a plurality of layers including at least a thermal recording layer on a support that is characterized in that an intermediate layer composed of gelatin as a binder is provided between at least one pair of two adjacent layers of the plurality of layers. Further, the steps for forming the thermal recording material by coating and drying the respective coating liquids for forming each layer that are characterized in that the drying process of the intermediate layer is performed while controlling wet membrane surface temperature at no higher than 35° C.

14 Claims, No Drawings

THERMAL RECORDING MATERIAL AND PRODUCTION METHOD THEREOF

BACKGROUND OF THE INVENTION

1. Field of the Invention

This invention relates to a thermal recording material and its production method, particularly relating to a high quality thermal recording material for a recording medium as medical applications and its production method.

2. Description of the Related Art

Use of thermal recording method offers many advantages. Some qualities which distinguish the thermal recording method include: (1) it does not require an image-developing process; (2) when using paper as a support, the support material quality resembles the quality of material similar to plain paper; (3) it is easy to handle; (4) its coloring density is high; (5) the recording device is simple, easy to use, highly reliable and cheap; (6) there is no noise during recording; and (7) it does not require maintenance. Therefore, recently the thermal recording method is developing in various fields. For example, its application has been expanded to the fields of facsimiles, printers, POS labels and the like.

Conventionally, the thermal recording materials used for thermal recording, utilize the reaction of electron-donating achromatic dyes with electron-accepting compounds, as well as the reaction of a diazo compound with a coupler, and so on.

In recent years, demand has risen for the development of thermal recording material with a thermal recording layer on a transparent support onto which one can directly record with a thermal head, for use in such applications as overhead projections and the direct viewing of images on light tables. Transparent thermal recording materials are increasingly receiving attention in the medical field for producing medical diagnostic imaging.

Such transparent recording material possesses excellent transparency, however its disadvantage is that sticking or noise tends to occur when the image is recorded with thermal recording equipment such as a thermal printer. High transmission density is required in medical uses of transparent thermal recording material, so the thermal energy applied by the thermal head is increased. The increased thermal energy aggravates certain problems, such as sticking, noise during recording, and wearing of the thermal head. In order to reduce sticking and noise, a protective layer comprising of pigment and a binder as main components is set on a thermal recording layer. In addition to the protective layer, other layers may be provided according as needed, such as a gas-blocking layer, an undercoating layer, an ultraviolet light filtering layer, and a light antireflection layer.

Two methods are known for providing these layers on a support is known. One method is by sequentially coating each layer on the support; another method involves multi-coating all the layers simultaneously with an exclusion die system. In both methods, prevention of interflow of the respective coated layers is necessary to produce a high quality thermal recording material. When interflow between coated layers occurs, the condition of the surface deteriorates and therefore it becomes impossible to produce high quality thermal recording material. Furthermore, in production of a thermal recording material, it is dried with a high-speed wind in a drying process in order to improve production efficiency, hence it suffers irregularity on the dried surface resulting in a deteriorated surface.

Particularly, when an image for medical diagnosis is produced using a transparent thermal recording material, it is impossible to accurately perform a diagnose is if an image cannot be clearly formed. Deterioration in the surface condition of the thermal recording material has adverse effects on an image being formed.

SUMMARY OF THE INVENTION

The present invention is made taking into consideration the above mentioned problems, and its purpose is to provide a thermal recording material with good surface condition for formation of a high quality image, and a production method of said material.

The aforementioned problems are solvable by providing the following thermal recording material. The present invention provides a thermal recording material having multiple layers including at least one thermal recording layer on a support, wherein the special characteristic of the thermal recording material is an intermediate layer using gelatin as a binder, which is interposed between at least one pair of adjacent layers of the multiple layers of the thermal recording material.

In an aspect, the invention may be a thermal recording material characterized by each of its layers being adjacent to the intermediate layer contains polyvinyl alcohol as a binder main component.

In another aspect, the invention may be a thermal recoding material characterized in that one of the multiple layers or the intermediate layer contains a phenolic compound.

In another aspect of the invention, the aforementioned thermal recording material characterized by having an emulsified liquid, which consists of an organic solvent solution with a low molecular weight of the emulsified phenolic compound.

In another aspect, the invention may be a thermal recording material characterized in that the emulsified liquid is one in which solution of the phenolic compound in a low molecular weight organic solvent is emulsified.

In another aspect, the invention may be a thermal recording material characterized in that the support is made of a polymer film.

Further, the present invention provides a production method of a thermal recording material comprising a step of forming multiple layers including at least one thermo sensitive layer and an intermediate layer having gelatin as a binder between at least one pair of adjacent layers of the multiple layers on a support by coating a coating liquid for forming each of the layers and drying it, characterized in that a drying step of the intermediate layer is performed while controlling temperature of a wet surface at or under 35° C. to produce one of the thermal recording materials (1) to (6) described above.

In another aspect, the invention may be a production method of the thermal recording material characterized in that all the multiple layers and the intermediate layer are simultaneously multi-coated by an exclusion die system.

DETAILED DESCRIPTION OF THE PREFERRED EMBODIMENTS

Hereinafter, a detailed description will be given on a thermal recording material according to the present invention The thermal recording material of the invention, on a support, has multiple layers including at least a thermal recording layer, an intermediate layer using gelatin as a binder between at least one pair of two adjacent layers of the multiple layers, and other layers if required. Intermediate Layer and Related Items:

The intermediate layer of the invention is formed between at least one pair of two adjacent layers of the multiple layers including at least one thermal recording layer. The multiple layers comprise, other than the thermal recording layer, a protective layer, a gas-blocking layer, an ultraviolet light filtering layer, a light anti-reflection layer, an undercoating layer and the like.

The intermediate layer is characterized by the fact that it includes gelatin. An aqueous solution of gelatin has flowability at high temperatures, but at lower temperatures (for example, under 35° C.), it loses its flowability and gelatinizes, thus endowing it with excellent setting properties. Therefore, when the layers are formed on the support by applying respective coating solutions for forming the multiple layers and drying them; or by sequentially coating the multiple layers and drying them; or by using the method of simultaneously multi-coating the multiple layers with an exclusion die system and the like and drying them, in any of the above methods, interflow between adjacent layers is effectively prevented. Thus results in obtaining a good surface state of thermal recording material.

As a result, a thermal recording material is obtained that is able to produce a high quality image. Further, when it is dried with a high-speed wind, the surface layer is not deteriorated, resulting in improved production efficiency. As for the gelatin used in the intermediate layer, either a non-modified (untreated) gelatin or a modified (treated) gelatin can be used without any trouble. Some usable treated gelatins include, lime-treated gelatin, acid-treated gelatin, phthalized gelatin, deionized gelatin, and enzyme-treated low molecular weight gelatin.

Further, various kinds of surfactant may be added to the intermediate layer to give the coating aptitude. Furthermore, in order to improve gas-barrier properties, fine inorganic particles such as mica may be added to the binder preferably at 2 to 20% by weight, and more preferably at 5 to 10% by weight.

Concentration of gelatin in a coating solution for the intermediate layer is preferably 3 to 25% by weight, and more preferably 6 to 15% by weight. An appropriate amount of dry coating for the intermediate layer is 0.5 to 6 g/m$^2$, and preferably 1 to 4 g/m$^2$.

Further, it is preferable that the intermediate layer and one of the multiple layers include a phenolic compound. The phenolic compound interacts with gelatin included in the intermediate layer, and the interaction of these layers gelates so that the effect of preventing interflow between layers is further improved. Furthermore, when the intermediate layer is dried at or under about 35° C., which is the setting temperature of the gelatin, in addition to setting characteristics of the gelatin itself, interaction between the phenolic compound and the gelatin is added so that the effect of preventing interflow between the layers becomes significantly better. Furthermore, due to the said interaction and/or the setting properties of the gelatin, drying by a high-speed window does not bring about deterioration of the surface, resulting in a superior thermal recording material with surface in excellent condition.

Particularly, when the two layers adjacent to the intermediate layer include polyvinylalcohol as a main component of a binder, the coating properties significantly improve when the two layers are formed by coating adjacent to the intermediate layer.

When the multiple layers and the intermediate layer are formed by sequential coating and drying, it is preferable that the phenolic compound is included in the layers adjacent to the intermediate layer. On the other hand, when the multiple layers and the intermediate layer are formed by simultaneous multi-coating, the phenolic compound may be added to any layer to obtain the effect of improved setting properties.

As for usable phenolic compounds, any compound that has more than one or more than two phenolic hydroxyl group(s) in a molecule can be used. For example, in addition to the bisphenol series compounds, bisphenol sulfone series compounds, and bisphenol sulfine series compounds shown bellow, phenolic compounds that are used as an electron-accepting compound for the purpose of coloring an electron-donating achromatic dye that is used as coloring component for a thermal recording material (e.g., phenols described in the paragraph 0032 and 0033 of Japanese Patent Application Laid-open No. 2000-272243) are used without any limitation.

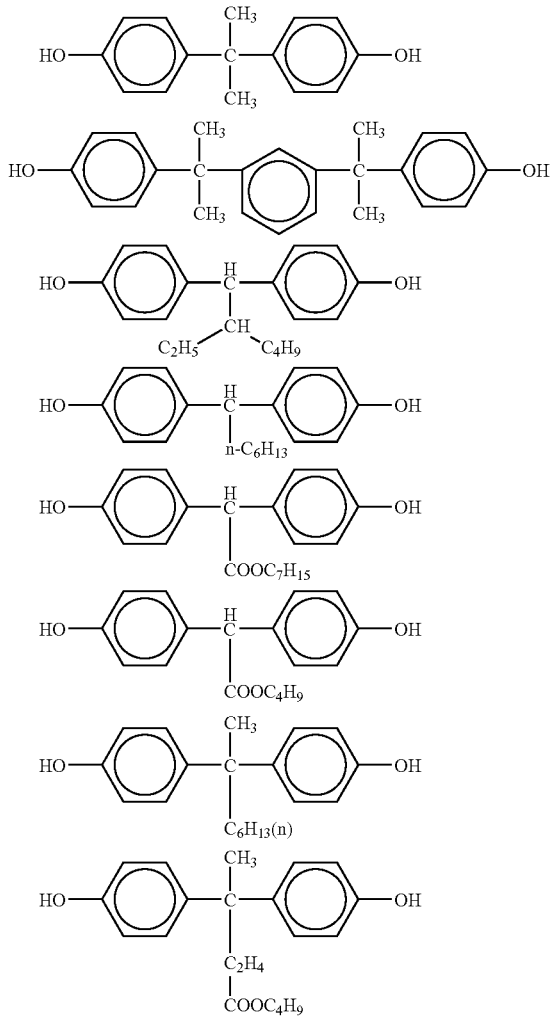

-continued

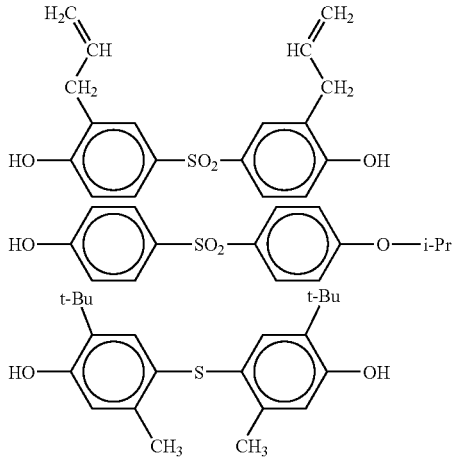

When an electron-donating achromatic dye is used as a coloring component for a thermal recording layer and phenols are used as an electron-accepting compound for coloring the colorant, the phenols can also be used as a phenolic compound to improve the setting properties of the intermediate layer, which contains gelatin.

In order to include phenolic compounds in each layer, it is preferable to add an emulsified liquid form of the phenolic compound to the coating liquid for each layer. When the emulsified liquid is prepared, it is preferable to use polyvinylalcohol as an emulsion stabilizer for the stability of the emulsified liquid, for the handling convenience of the coating liquid (Note: the emulsified gelatin liquid is extremely sticky and of high-viscosity), and for the diffusion properties on the coating. In addition, when the emulsified liquid is prepared, it is preferable to emulsify the phenolic compound dissolved in a low molecular organic solvent. By using the low molecular organic solvent, it becomes easier to perform emulsification, and furthermore, it becomes easier for the phenolic compound to move from droplets of the emulsified liquid to the consecutive layers, which facilitates obtaining improved setting properties. As the low molecular organic solvent, ethyl acetate, isopropyl acetate, butyl acetate, methylene chloride, and the like are preferably used. Among them, esters are preferable in view of solubility of the phenolic compound, emulsifying aptitude, stability of the emulsified liquid and the degree of solubility into water phase.

The amount of phenolic compound added varies depending on the protective colloid to be used, the molecular weight distribution of the gelatin, and the like. In relation to the solid content of the gelatin in the adjacent layer, the preferable amount is over 5% by weight, and a particularly preferable amount is over 10% by weight.

Thermal Recording Layer:

The thermal recording layer comprises at least a coloring ingredient, and, if required, other ingredients as well.

Coloring Ingredient:

Any thermal recording material can be used, regardless of its composition, as long as if the thermal recording layer posesses excellent transparency at the untreated stage, and disposition of coloring when heated.

For this type of thermal recording layer, what is termed as a two-component type thermal recording layer can be listed, which comprises a substantially colorless coloring component A and a substantially colorless coloring component B that can react with A to form color. It is preferable that either of the coloring component A or the coloring component B is contained in a microcapsule. As pairings of two ingredients constituting the two-component type thermal recording layer, the following (a) through (m) can be listed:

(a) a paring of an electron-donating dye precursor and an electron-accepting compound;

(b) a paring of a photodegradable diazo compound and a coupler;

(c) a paring of an organic metal salt such as silver behenate, silver stearate or the like and a reducing agent such as protocatechin acid, spiro indan, hydroquinone or the like;

(d) a paring of a salt of a long-chain aliphatic acid such as ferric stearate, ferric myristate and phenols such as gallic acid, ammonium salicylate;

(e) a paring of a heavy metal salt of an organic acid, which is constituted of acetic acid, stearic acid palmitic acid or the like and a salt of nickel, cobalt, lead, copper, iron, mercury, silver or the like, and an alkali earth heavy metal sulfide such as calcium sulfide, strontium sulfide, potassium sulfide or the like; or a paring of the heavy metal salt of an organic acid and an organic chelating agent such as s-diphenylcarbazide, diphenylcarbazon;

(f) a paring of a (heavy) metal sulfide such as silver sulfide, lead sulfide, mercury sulfide, sodium sulfide or the like and a sulfur compound such as sodium tetrathionate, sodium thiosulfate, thiourea or the like;

(g) a paring of an aliphatic ferric salt such as ferric stearate or the like and an aromatic polyhydroxy compound such as 3,4-dihydroxytetraphenyl metane or the like;

(h) a paring of an organic precious metal salt such as silver oxalate or mercury oxalate or the like and an organic polyhydroxy compound such as polyhydroxy alcohol, glycerin, glycol or the like;

(i) a paring of a aliphatic ferric salt such as ferric pelargonate, ferric laurate or the like and a derivative of thiocethyl carbamide or isothiocethyl carbamide or the like;

(j) a paring of a lead salt of organic acid such as lead caproate, lead pelargonate, lead behenate or the like and a thiourea derivative such as ethylene thiourea, N-dodecylthiourea or the like;

(k) a paring of a heavy metal salt of higher fatty acid such as ferric stearate, copper stearate or the like and zinc dialkyl dithiocarbamate or the like;

(l) a paring resulting in formation of oxazine dye such as resorcine and one of nitroso compounds; and (m) a paring of one of formazan compounds and a reducing agent and/or a metal salt.

Among these, in the thermal recording material of the presennt invention, it is preferable to use (a) a paring of an electron-donating dye precursor and an electron-accepting compound; (b) a paring of a photodegradable diazo compound and a coupler; or (c) a paring of an organic metal salt and a reducing agent. Of these combinations, the aforementioned (a) or (b) is especially preferable.

In the present invention, an image posessing superior transparency can be made by constituting the thermal recording layer so as to reduce the haze value, which is calculated by the equation (diffused transmittance/total optical transmittance)×100 (%). The haze value is an index representing the transparent properties of the material and is generally calculated based on the total optical transmittance, diffusion transmittance and parallel transmittance using a haze meter.

In the invention, examples of methods to reduce the haze value are as follows: 50% volume mean particle diameter of both of above described coloring components A and B contained in the thermal recording layer is reduced to not more than 1.0 μm or less, preferably not more than 0.6 μm, and the binder is contained in the range from 30 to 60% by weight of the total solid content of the thermal recording layer; either A or B of aforementioned coloring components is encapsulated and the other is used in a form of, for example, emulsified material that can constitute a substantially continuous layer after coating and drying.

Further, a method where the respective refraction factors of the components used in the thermal recording layer are as constant as possible is also effective.

Next, a detailed description will be given on the aforementioned parings of components (a, b, and c) that are preferably used for the thermal recording layer.

Firstly, the paring of an electron-donating dye precursor and an electron-accepting compound is explained.

There is no particular limitation for the electron-donating dye precursor used in the invention as long as the compound is substantially transparent. The electron-donating dye precursor is preferably a colorless compound having properties such that it develops color by releasing an electron or accepting a proton from an acid or the like, and particularly having a partial bone structure of lactone, lactam, silton, spiropyran, ester, amido and the like, which opens or splits when being contacted with the electron-accepting compound.

Examples of electron-releasing dye precursor include triphenylmetanephthalide series compounds, fluoran series compounds, phenothiazine series compounds, indolylphthalide series compounds, leucoauramine series compounds, rhodaminelactam series compounds, triphenylmethane series compounds, triazene series compounds, spiropyran series compounds, fluorene series compounds, pyridine series compounds, and pyrazine series compounds.

Specific exmaples of the phthalide series compounds include those compounds described in U.S. Reissue Pat. No. 23,042, U.S. Pat. Nos. 3,491,111, 3,491,112, 3,491,116 and 3,509,174.

Specific exmaples of the fluoran series compounds include those compounds described in U.S. Pat. Nos. 3,624,107, 3,627,787, 3,641,011, 3,462,828, 3,681,390, 3,920,510 and 3,959,571.

An example of the spiropyran series compound is one described in U.S. Pat. No. 3,971,808.

Examples of the aforementioned pyridine series and pyrazine series compounds include those compounds described in U.S. Pat. Nos. 3,775,424, 3,853,869 and 4,246,318.

An example of the fluorene series compounds is described in Japanese Patent Application No. 61-240989.

Among these compounds, 2-arylamino-3-[H, halogen, alkyl or alkoxy-6-substituted aminofluoran], which produces black, is particularly preferable.

Specific examples include 2-anilino-3-methyl-6-diethylamino fluoran, 2-anilino-3-methyl-6-N-cyclohexyl-N-methylamino fluoran, 2-p-chloroanilino-3-methyl-6-dibutylamino fluoran, 2-anilino-3-methyl-6-dioctylamino fluoran, 2-anilino-3-chloro-6-diethylamino fluoran, 2-anilino-3-methyl-6-N-ethyl-N-isoamileamino fluoran, 2-anilino-3-methyl-6-N-ethyl-N-dodecylamino fluoran, 2-anilino-3-methoxy-6-dibutylamino fluoran, 2-o-chloroanilino-6-dibutylamino fluoran, 2-p-chloroanilino-3-ethyl-6-N-ethyl-N-isoamileamino fluoran, 2-o-chloroanilino-6-p-butylanilino fluoran, 2-anilino-3-pentadecile-6-diethylamino fluoran, 2-anilino-3-ethyl-6-dibutylamino fluoran, 2-o-toluidino-3-methyl-6-diisopropylamino fluoran, 2-anilino-3-methyl-6-N-isobutyl-N-ethylamino fluoran, 2-anilino-3-methyl-6-N-ethyl-N-tetrahydrofurfurylamino fluoran, 2-anilino-3-chloro-6-N-ethyl-N-isoamileamino fluoran, 2-anilino-3-methyl-6-N-methyl-N-γ-ethoxypropylamino fluoran, 2-anilino-3-methyl-6-N-ethyl-N-γ-ethoxypropylamino fluoran, and 2-anilino-3-methyl-6-N-ethyl-N-γ-propoxypropylamino fluoran and the like.

Examples of electron-accepting compounds that react with the electron-donating dye precursor include acidic materials such as phenolic compounds, organic acids or their metal salts, and oxybenzoic acid esters. Examples of these compounds are described in Japanese Patent Application Laid-open No. 61-291183.

Specific examples include: bisphenols such as 2,2-bis(4'-hydroxyphenyl)propane (common name: bisphenol A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphehyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4'-hydroxyphenyl)-2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone, and bis(p-hydroxyphenyl)benayl acetate ester; salicylic acid derivatives such as 3,5-di-α-methylbenayl salicylic acid, 3,5-di-tertiarybutyl salycylic acid, 3-α-α-dimethylbenayl slycylic acid, 4-(β-p-methoxyphenoxyethoxy)salicylic acid and the like; their polyvalent metal salts (salts of zinc and aluminum are especially preferable); oxybenzoic acid esters such as p-hydroxy benayl benzoate ester, p-hydroxy benzoic acid-2-ethylhexyl ester, β-resorcinic acid-(2-phenoxyethyl) ester; and phenols such as p-phenylphenol, 3,5-diphenylphenol, cumylphenol, 4-hydroxy-4'-isopropoxy-diphenylsulfone, and 4-hydroxy-4'-phenoxy-diphenylsulfone and the like.

Among these, bisphenols are particularly preferable in view of realizing good coloring properties.

Further, one electron-accepting compound can be used independently, or two or more of them can be used in combination.

Next, a description will be given on (b) the a paring of photodegradable diazo compound and a coupler.

The photodegradable diazo compound means a photodegradable diazo compound that develops color of desired hue when subjected to coupling reaction with a coupler, which is a coupling ingredient mentioned hereinafter, and is degraded when exposed to light of a specific wave length before the reaction to where it loses its coloring ability if there remains the coupling ingredient.

The hue in this coloring system is determined by a diazo dye produced by the reaction of a diazo compound with a coupler. Therefore, by changing the chemical structure of the diazo compound or the coupler, it is quite easy to change the hue, and is possible to obtain any developed hue depending on the combination of them.

The photodegradable diazo compounds preferably used in the present invention are aromatic series diazo compounds, and include specificaly, aromatic series diazonium salts, diazosulfonate compounds, diazoamino compounds and the like.

As the aromatic series diazonium salts, those indicated by the following general formula can be listed, however, they are not limited to these only. Among the aromatic series diazonium salts, those that are best for use are those that have light fixability, do not produce many colored stains after fixation, and have a stable coloring area.

$Ar—N_2^+X^-$

In the above general formula, Ar represents an aromatic series carbon hydride ring group having or not having a substituent, $N_2^+$ represents a diazonium group and $X^-$ represents an acid anion.

These days, many diazosulfonate compounds are known. They are obtained by treating each diazonium salt with a sulfite salt and are suitably used for the thermal recording material of the invention. The diazo amino compound can be obtained by coupling a diazo group with dicyandiamide, sarcosine, methyltaurine, N-ethylanthranic acid-5-sulfonic acid, monoethanolamine, diethanolamine, guanidine or the like, and is suited for use with the thermal recording material of the present invention.

Detailed explanations on these diazo compounds are given in the Japanese Patent Application Laid-open No. 2-1362086.

Also, regarding couplers to be coupling-reacted with the above-mentioned diazo compounds, in addition to 2-hydroxy-3-naphthoic anilide and the like, resorcine and those described in Japanese Patent Application Laid-open No. 62-146678 may be used.

When the pair of a diazo compound and a coupler is used in the thermal recording material, from a viewpoint that the coupling reaction can be accelerated by reacting in a basic atmosphere, a basic material may be added as a sensitizer.

As the basic material, materials include those that create a water-insoluble or hardly soluble basic material or a material that generates alkali by heating. Examples of them include inorganic or organic ammonium salts, organic amine, amide, urea and thiourea, or their derivatives; nitrogen containing compounds such as thiazoles, pyrroles, pyrimidines, piperazines, guanidines, indoles, imidazoles, imidazolines, triazoles, morpholines, piperidines, amidines, folm azine, and pyridines.

Specific examples are described in Japanese Patent Application Laid-open No. 61-291183.

Next, a description will be given on the paring of an organic metal salt and a reducer.

Specific examples of the organic metal salts include: silver salts of long-chain aliphatic carboxylic acid such as silver laurate, silver myristate, silver palmitate, silver stearate, silver arachate, silver behenate and the like; silver salts of organic compound having imino group(s) such as benzotriazole silver salt, benzimidazole silver salt, carbazole silver salt, phthalazinon silver salt and the like; silver salts of sulfur-containing compound such as s-alkyl thioglycolate; silver salts of aromatic carboxylic acid such as silver benzoate, silver phthalate and the lik; silver salts of sulfonic acid such as silver ethane sulfonate; silver salts of sulfinic acid such as silver o-toluenesulfinate and the like; silver salts of phosphoric acid such as silver phenylphosphate; also, silver barbiturate, silver saccharate, silver salt of salicylasdxym, and arbitrary mixtures of them.

Among them, silver salts of long chain aliphatic carboxylic acid are preferable, and silver behenate is most preferable of all of them. Further, behenic acid may be used together with silver behenate.

The reducers can be used in accordance with the description listed from line 14 of lower left column on page 227 to line 11 of upper right column on page 229 of Japanese Patent Application Laid-open No. 53-1020. Among them, mono, bis, tris or tetrakisphenols, mono or bis naphthols, di or polyhydroxynaphthalenes, di or polyhydroxybenzenes, hydroxymonoethers, ascorbic acids, 3-pyrazolidones, pyrazolins, pyrazolones, reducing saccharides, phenylenediamines, hydroxylamines, reductones, hydrooxyamic acids, hydrazides, amidoximes, N-hydroxyureas and the like can be preferably used.

Among them, use of aromatic organic reducer such as polyphenols, sulfoneamide phenols, and naphthols are particularly preferable.

In order to assure an adequate transparency of the thermal recording material, it is preferable to use in the thermal recording layer either of the follwing pairings: (a) electron-donating dye precursor and electron-accepting compound, or (b) a photodegradable diazo compound and a coupler. Also, in the present invention, it is preferable to use either of the coloring ingredients A or B in the state of micro-encapsulation, and is even more preferable to use the electron-donating dye precursor or photodegradable diazo compound in a state of micro-encapsulatioe.

Microcapsule:

A detailed description will be given below on a production method of a microcapsule.

For producing a microcapsule, there are such methods as an interfacial polymerization method, an internal polymerization method, an external polymerization method, any of which can be adopted for use.

As mentioned above, it is preferable for the thermal recording material of the invention to micro-encapsulate either the electron-donating dye precursor or the photodegradable diazo compound. Particularly, it is preferable to adopt an interfacial polymerization method comprises the following steps of: mixing an oil phase, which forms the core of the capsule, prepared by dissolving or dispersing the electron-donating dye precursor or the photodegradable diazo compound in an hydrophobic organic solvent with an aqueous phase dissolving a water soluble polymer; emulsion-dispersing the mixture with means such as a homogenizer and the like; and giving rise to polymer formation reaction on the interface of oil drops by heating to form a microcapsule wall of the polymer.

Reactant to form the polymer is added to an internal and/or external part of the oil drop. Specific examples of the high polymer include polyurethane, polyurea, polyamide, polyester, polycarbonate, urea-formaldehyde resin, melamine resin, polystyrene, styrene-methacrylate copolymer, styrene-acrylate copolymer and the like. Among them, polyurethane, polyurea, polyamide, polyester, polycarbonate are preferable, with polyurethane and polyurea being particularly preferable.

When, for example, polyurea is used as a capsule wall material, it is easy to form a microcapsule wall by reaction in polyisocyanates such as disocyanates, trisocyanates, tetraisocyanates or polyisocyanate prepolymers with polyamines such as diamine, triamine, tetramine, prepolymer having not less than two amino groups, piperazine or its derivative polyol or the like, in the water phase by the interfacial polymerization method.

Further, conjugated walls, for example, constituted of polyurea and polyamide or of polyurethane and polyamide respectively, can be prepared for example by mixing a polyisocyanate and a second material capable of reacting with the polyisocyanate to form a capsule wall (e.g., acid chloride, polyamine or polyol) into a water-soluble high polymer solution (water phase) or oil-medium to be encapsulated (oil phase), emulsion-dispersing, followed by heating up the mixture. Details of the production method of the conjugated wall made by polyurea and polyamide are described in Japanese Patent Application Laid-open No. 58-66948.

For the polyisocyanate compound, compounds having no less than trifunctional isocyanate groups are preferable, however those having bifunctional isocyanate groups may be additionally used.

Specific examples of the polyisocyanates are, in addition to dimer or trimer (biuret or isocyanurate) made from diisocyanate as a main component such as xylenediisocyanate and its hydrogenated object, hexamethylenediisocyanate, trilendiisocyanate and its hydrogenated object, isophoronediisocyanate, multifunctional ones as an adduct of polyol such as trimethylolpropane and the like and bifunctional isocyanate such as xylylenediisocyanate and the like, compounds in which high-molecular weight compound such as polyether and the like having an active hydrogen such as polyethyleneoxyde to an adduct of polyol such as trimethylolpropane and the like and bifunctional isocyanate such as xylylenediisocyanate and the like, and formaldehyde condensate of benzeneisocyanate and the like.

The compounds described in Japanese Patent Application Laid-open Nos. 62-212190, 4-26189, 5-317694, 8-268721 and the like are preferred.

The polyisocyanate is preferably added so that the average diameter of the microcapsule would be 0.3 to 12 μm and the thickness of the microcapsule wall would be 0.01 to 0.3 μm. The distributed particle diameter is generally 0.2 to 10 μm.

Specific examples of polyols or/and polyamines that are added to aqueous phase and/or oil phase and reacts with polyisocyanate to form one of component substances of microcapsule wall include propyleneglycol, glycerin, trimethylolpropane, triethanolamine, sorbitol, hexamethylene diamine and the like. When the polyol is added, a polyurethane wall is formed. In order to accelerate the reaction speed in the reaction, it is preferable to keep the reaction temperature high, or to add an appropriate polymerization.

Detailed explanations on polyisocyanate, polyol, reaction catalysts or polyamine in forming a part of the wall material are available in "*Polyurethane Handbook*" (edited by Toshiharu Iwata, published by Daily Industrial Newspaper Publisher [1987]).

Further, if necessary, a metal-containing dye, a charge regulant such as nigrosin, or other optional additives can be added to the wall of the microcapsule. These additives can be contained in the microcapsule wall when the wall is formed or at the maker's discretion. Also, if necessary, in order to regulate the electrostatic property of the surface of the capsule wall, a monomer such as vinylmonomer may be graft polymerized to the wall.

Furthermore, in order to improve the microcapsule wall's excel in permeability at lower temperatures and to richen its coloring properties, it is preferable to use a plasticizer suitable to the polymer used as a wall material. It is preferable that the melting point of the plasticizer be higher than 50° C., and even more preferable that it not exceed 120° C. Among these plasticizers, those that are solid at room temperature or below can be suitably selected and used.

For example, when the wall material is comprised of polyurea and polyurethane, compounds such as a hydroxy compound, a carbamic ester compound, an aromatic alkoxy compound, an organic sulfoneamide compound, and an aliphaticamide compound, an arylamide compound can be suitably used.

When the oil phase is prepared, the hydrophobic organic solvent used to dissolve the electron-donating dye precursor or photodegradable diazo compound to form a core of the microcapsule is preferably an organic solvent having a boiling point of 100 to 300° C.

Specifically, in addition to ester, the following can be listed: dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmetane, 1-etyl-1-dimethylphenyl-1-pheylmetane, 1-propyl-1-dimethylphenyl-1-phenylmetane, triallylmetane (e.g., tritoluylmetane, toluyldiphenylmetane), terphenyl compounds (e.g., terphenyl), alkyl compounds, alkylated diphenylether (e.g., propyldiphenylether), hydrogenated terphenyl (e.g., hexahydroterphenyl), diphenylether, etc. Among them, in terms of emulsion stability of the emulsion-dispersed materials, it is particularly preferable to use esters.

As for aforementioned esters, the following can be listed: phosphate esters such as triphenyl phosphate, tricrezil phosphate, butyl phosphate, octyl phosphate, crezilphenyl phosphate and the like; phthalate esters such as dibutyl phthalate, 2-ethylhexyl phthalate, ethyl phthalate, octyl phthalate, butylbenzyl phthalate; tetrahydro diocthyl phthalate and the like; benzoate esters such as ethyl benzoate, propyl benzoate, butyl benzoate, isopenthyl benzoate, benzyl benzoate and the like; abietate esters such as ethyl abietate, benzyl abietate; dioctyl adipate and the like; isodecyl succinate; dioctyl azelate; oxalate esters such as dibutyl oxalate, dipentyl oxalate and the like; diethyl malonate; maleate esters such as dimethyl maleate, diethyl maleate, dibutyl maleate and the like; tributyl citrate; sorbate esters such as methyl sorbate, ethyl sorbate, butyl sorbate and the like; sebacate esters such as dibutyl sebacate, dioctyl sebacate and the like; etylene glycol esters such as monoester formate and diester formate, monoester butyrate and diester butyrate, monoester laurate and diester laurate, monoester palmitate and diester palmitate, monoester stearate and diester stearate, monoester oleate and diester oleater and the like; triacetin; diethyl carbonate; diphenyl carbonate; ethylene carbonate; propylene carbonate; borate esters such as tributyl borate; tripentyl borate and the like.

Among them, when particularly tricrezil phosphate is used independently or in mixture with others, the resulting stability of the emulsion material is the best and preferable. It is possible to use a mixture of the above-mentioned oils or a mixture of the above-mentioned oil with other oils.

When the solubility of the electron-donating dye precursor, or photodegradable diazo compound into the hydrophobic organic solvent, is inferior, it is possible to additionally use a low boiling point solvent that has highly dissolving ability. Ethyl acetate, isopropyl acetate, butyl acetate, and methylene chloride are good examples of low boiling point solvent.

When the electron-donating dye precursor or photodegradable diazo compound is used for the thermal recording layer in the thermal recording material, the content of the electron-donating dye precursor is preferably 0.1 to 5.0 $g/m^2$, and even more preferably 1.0 to 4.0 $g/m^2$.

Also content of the photodegradable diazo compound is preferably 0.02 to 5.0 $g/m^2$, and even more preferably 0.10 to 4.0 $g/m^2$.

When the content of the electron-donating dye precursor is ranged from 0.1 to 5.0 $g/m^2$, satisfactory coloring density can be obtained, and when each content of the electron-donating dye precursor and the photodegradable diazo compound is within 5.00 $g/m^2$, satisfactory coloring density can be maintained and further transparency of the thermal recording layer is maintained.

On the other hand, in s water phase used, an aqueous solution in which water-soluble polymer is dissolved is used as a protective colloid. After addition of the oil phase to the water phase, emulsion-dispersion is performed using a means such as a homegenizer. In this case, the water-soluble polymer reacts as a dispersion carrier so that the aqueous solution may be evenly and easily dispersed and also the aqueous solution after emulsion dispersion may be stabilized. Here, in order to perform emulsion dispersion more evenly to stabilize, a surfactant may be added to at least either of the oil or water phase. As the surfactant, it is possible to use a well-known surfactant for emulsion. The amount of the surfactant added is preferably 0.1 to 5% relative to the mass of the oil phase, and more preferably 0.5 to 2%.

As the surfactant to be contained in the water phase, those preferably used are selected from anionic or nonionic surfactants, which do not react to the protective colloid to form precipitates or agglutinates.

Preferable surfactants are, for example, sodium alkylbenzen sulfonate, sodium alkylsulfate, sodium dioctyl sulfosuccinate, polyalkylene glycol (for example, polyoxyethylene nonyl phenyl ether) and the like.

Emulsification of the oil phase containing the above-mentioned ingredients and the water phase containing the protective colloid and the surfactant is easily performed with means used for usual fine particle emulsification such as high-speed stirring, ultrasonic dispersion and the like, for example known emulsification apparatus such as a homegenizer, a Mantongorrie, an ultrasonic dispersion equipment, a dissolver, a Keddy mill and the like. After emulsification, in order to promote the reaction of forming the capsule wall, the emulsified material is preferably warmed up to a temperature of 30 to 70° C. Also, in order to avoid agglutination of capsules to each other during its reaction, it is preferable to add water to reduce the probability of collision between capsules and to perform enough stirring.

Further, dispersed material for inhibiting agglutination may be added anew during the reaction. With the progress of the polymerization reaction, generation of carbon dioxide is observed and extinction of the generation cab be assumed as the approximate end point of the capsule wall-forming reaction. In general, by reacting over a period of hours, the targeted microcapsule is prepared.

Emulsion-Dispersed Material:

When the electron-donating dye precursor, or photodegradable diazo compound is used as a core material of the microcapsule, the electron-accepting compound or a coupler to be paired respectively is used, for example, by being dispersed in solid form together with a water-soluble polymer and an organic base, and an auxiliary agent for coloring and the like using a sand mill. However, it is more preferable that they are used as an emulsion-dispersed material prepared according to the steps of dissolving them previously into an organic solvent with a high boiling point that is hardly soluble or insoluble in water to result in a solution, mixing the solution with a polymer solution (water phase) containing a surfactant and/or a water soluble polymer as a protective colloid to result in a mixture, and then emulsifying the mixture with a homogenizer and the like. In this case, if necessary, it is possible to use a solvent with a low boiling point as a subsidiary agent for dissolution.

Further, it is possible to perform emulsion dispersion of the coupler and the organic base separately, or to perform emulsion dispersion after dissolving a mixture of them into a high boiling point organic solvent. Preferable diameter of the emulsion-dispersed particle is not more than 1 μm.

The high boiling point organic solvent to be used in this case is selected as much as is needed, for example, from high boiling point oils described in Japanese Patent Application Laid-open No. 2-141279.

Among them, it is preferable to use esters from the viewpoint of emulsion stability of the emulsion-dispersed liquid, and among them it is particularly preferable to use tricresyl phosphate. It is also possible to use a mixture of above-mentioned oils or the oil together with other oils.

The water-soluble polymer contained as the protective colloid is selected as much as is desired from known anionic polymer, nonionic polymer and amphoteric polymer, and water-soluble polymer with solubility of not less than 5% into water at temperature for emulsification. As specific examples, the following can be listed: cellulose derivative such as polyvinylalcohol or modified polyvinylalcohol, polyamide acrylate or its derivatives, ethylene-vinyl acetate copolymer, styrene-maleic anhydride copolymer, ethylene-maleic anhydride copolymer, isobutylene-maleic anhydride copolymer, polyvinylpyrrolidone, ethylene-acrylic acid copolymer, vinyl acetate-acrylic acid copolymer, carboxymethyl cellulose, methyl cellulose; casein; gelatin; starch derivatives; gum arabic; sodium alginate and the like.

Among them, polyvinyl alcohol, gelatin and cellulose derivatives are particularly preferable.

Mixing ratio of the oil phase to the water phase (weight of the oil phase/weight of the water phase) is preferably 0.02 to 0.6, and more preferably 0.1 to 0.4. When the mixing ratio is within the range of 0.02 to 0.6, the viscosity is maintained to a moderate degree, aptitude for manufacture is excellent and the stability of coating liquid is excellent.

When an electron-accepting compound is used for the thermal recording material of the invention, the amount of the electron-accepting compound related to 1 by weight of the electron-donating dye precursor is preferably 0.5 to 30 by weight, and more preferably 1.0 to 10 by weight.

Also, when a coupler is used for the thermal recording material of the invention, amount of the coupler related to 1 by weight of the diazo compound is preferably 0.1 to 30 by weight.

Coating Solution for the Thermal Recoding Layer:

A coating solution for the thermal recording material can be prepared, for example, by mixing the microcapsule fluid prepared in the above-mentioned manner and the emulsion-dispersed material. Here, the water-soluble polymer used as a protective colloid when the microcapsule fluid is prepared, and the water-soluble polymer used as a protective colloid when the emulsion-dispersed material is prepared function as a binder in the thermal recording layer. Also, other than these protective colloids, another binder may be added and mixed to prepare the coating solution for the thermal recording layer.

In general, water soluble binders are added, and the following can be listed: polyvinyl alcohol, hydroxyethyl cellulose, hydroxypropyl cellulose, epichlorhydrin modified polyamide, ethylene-anhydrous maleic acid copolymer, styrene-maleic anhydride copolymer, isobutylene-mallein salicylate anhydride copolymer, polyacrylic acid, polyamide acrylate, methylol modified polyacrylamide, starch derivative, casein, gelatin and the like.

Also, it is possible to add a water-resistant agent or emulsion of hydrophobic polymer, specifically styrene-butadiene rubber latex, acrylic resin emulsion and the like, to the binder for the purpose of giving it a water-resistant property.

When the coating liquid for the thermal recording layer is applied onto a support, a known coating method that is used for an aqueous or organic coating liquid is used. In order to coat the coating liquid for the thermal recording layer safely and evenly, and in order to maintain the strength of the coated layer, it is possible to use, in the thermal recording material of the invention, methyl cellulose, carboxymethyl cellulose, hydroxyethyl cellulose, starches, gelatin, polyvinylalcohol, carboxy-modified polyvinylalcohol, polyacrylamide, polystyrene or its copolymer, polyester or its copolymer, polyethylene or its copolymer, epoxy resin, acrylate series resin or its copolymer, methacrylate series resin or its copolymer, polyurethane resin, polyamide resin, polyvinylbutyral resin and the like.

Miscellaneous Ingredients:

Hereinafter, a description will be given on miscellaneous ingredients usable for the thermal recording layer.

As for the above-mentioned ingredients, there is no limitation and material can be selected as much as is desired according to purposes. For example, a known heat-fusable material, an ultraviolet absorber, an antioxidant and the like are listed.

It is possible to add the heat-fusible material in the thermal recording layer for the purpose of improving its heat response properties.

As heat-fusible material, aromatic ether, thioether, ester, aliphatic amide, ureide and the like can be listed.

These examples are described in Japanese Patent Application Laid-open Nos. 58-57989, 58-87094, 61-58789, 62-109681, 62-132674, 63-151478, 63-235961, 2-184489, 2-215585 and the like.

As the ultraviolet absorber, benzophenone series ultraviolet absorber, benzotriazole series ultraviolet absorber, salicylic acid series ultraviolet absorber, cyanoacrylate series ultraviolet absorber, oxalic acid anilide series ultraviolet absorber and the like are preferably listed. These examples are described in Japanese Patent Application Laid-open Nos. 47-10537, 58-111942, 58-212844, 59-19945, 59-46646, 59-109055, 63-53544, Japanese Patent Publication Nos. 36-10466, 42-26187, 48-30492, 48-31255, 48-41572, 48-54965, 50-10726, U.S. Pat. Nos. 2,719,086, 3,707,375, 3,754,919, 4,220,711 and the like.

As the antioxidant, hindered amine series antioxidant, hindered phenol series antioxidant, aniline series antioxidant, quinoline series antioxidant and the like are preferably listed. These examples are described in Japanese Patent Application Laid-open Nos. 59-155090, 60-107383, 60-107384, 61-137770, 61-139481, 61-160287 and the like.

The coated amount of the miscellaneous ingredient is preferably 0.05 to 11.0 g/m$^2$, and more preferably 0.1 to 0.4 g/m$^2$. It is possible to add the miscellaneous ingredient to the inside or outside of the microcapsule.

The thermal recording layer is preferably a thermal recording layer having a wide energy quantity width necessary to obtain the saturated transmission density ($D_{T\text{-}max}$), that is to say, having a wide dynamic range in order to restrain density irregularity and the like arising from a little difference of thermal conductivity in a thermal head and the like to obtain an image with high quality. The thermal recording material of the invention contains a thermal recording layer as described above, which preferably has properties of being capable of obtaining transmission density of $D_T$ 3.0 by heat energy quantity ranging from 90 to 150 mJ/mm$^2$.

For the thermal recording layer, it is preferable that coating is performed so that dried spread after coating and drying is 1 to 25 g/m$^2$ and thickness of the layer is 1 to 25 μm. It is possible to use a thermal recording layer composed of two or more layers in a laminate. In this case, dry spread of the entire thermal recording layer after coating and drying is preferably 1 to 25 g/m$^2$.

Protective Layer:

A protective layer is formed on the thermal recording layer, or on an intermediate layer in case that the intermediate layer is formed on the thermal recording layer as the miscellaneous layer.

To the protective layer, additives, for example, such as an anti-sticking agent, a mold lubricant, a lubricant, a slipping agent, a surface gloss controlling agent, a matting agent and the like can be added.

The anti-sticking agent is applied to prevent the thermal head from fusion bonding (sticking) to the thermal recording material, from dregs attaching, or from generating abnormal noise on the thermal recording, and can include various kinds of pigments.

The pigment that can be used for the protective layer preferably has an average diameter, for more information the 50% volume average diameter measured by a laser diffraction method (the average particle diameter of pigment corresponding to 50% volume of the pigment; measured by a laser diffraction particle size distribution measurement equipment LA700 (trade name, manufactured by Horiba Ltd); hereinafter it may be simply referred to as "average particle diameter") of 0.10 to 5.00 μm. Particularly, from the viewpoint of preventing from sticking between the thermal head and the thermal recording material and generating abnormal noise while recording with the thermal head, the 50% volume average particle diameter is preferably in the range of 0.20 to 0.50 μm.

If the 50% volume average particle diameter is ranged from 0.10 to 5.00 μm, the effect to reduce abrasion of the thermal head is significant and the effect to prevent from welding between the thermal head and the binder in the protective layer is significant, and as a result, it is possible to effectively prevent sticking of the thermal head and the protective layer of the thermal recording material while printing.

As the pigment included in the protective layer, without any limitation, known organic or inorganic pigments can be listed. Particularly, inorganic pigment such as calcium carbonate, titanium oxide, kaolin, aluminum hydroxide, amorphous silica, zinc oxide and the like, and an organic pigment such as urea-formalin resin, epoxy resin and the like are preferable. Among them, kaolin, aluminum hydroxide and amorphous silica are more preferable. It is possible to use such a pigment independently or use two or more pigments together.

Further, a surface of the pigment may be coated with at least one selected from a group consisting of higher fatty acid, metal salt of higher fatty acid and higher alcohol.

As the higher fatty acid, stearic acid, palmitic acid, myristic acid, lauric acid and the like can be listed.

It is preferable to use these pigments after being dispersed together with an auxiliary agent such as, for example, sodium hexametaphosphate, partially or completely saponificated modified polyvinyl alcohol, polyacrylic acid copolymer, various kinds of surfactant, and preferably with partially or completely saponificated modified polyvinyl alcohol or polyacrylic acid copolymer ammonium salt with a known dispersion apparatus such as a dissolver, a sand mill, a ball mill or the like to be the above-mentioned average diameter. That is to say, it is preferable that the pigment is used after its 50% volume average diameter is dispersed up to the diameter ranged from 0.10 to 5.00 μm.

As the mold lubricant, lubricant and slipping agent, other than higher fatty acid (carbon number ranges from 8 to 24) or their metal salt, amide compounds represented by the following structural formulas (1) to (3) are listed. As the mold lubricant, stearic acid, zinc stearate, amide stearate and the like are preferably used.

Structural Formula (1)

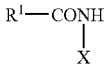

Structural Formula (2)

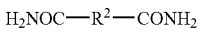

Structural Formula (3)

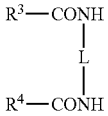

In structural formulae (1) to (3), X represents H or $CH_2OH$; each of $R^1$, $R^2$, $R^3$ and $R^4$ independently represents a saturated or unsaturated alkyl group having 8 to 24 carbon atoms that may be branched or hydroxylated. $R^3$ and $R^4$ may be identical or different.

L is represented by the following structural formula (4).

Structural Formula (4)

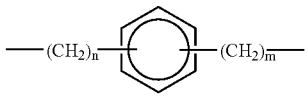

In the structural formula (4), n+m=0 to 8.

Among them, compounds represented by the structural formula (1) and (3) are particularly preferable, and each of $R^1$, $R^3$ and $R^4$ is preferably a saturated or unsaturated alkyl group having carbon atoms ranging from 12 to 20. The alkyl group may be branched or contain hydroxyl group in its structure. When h=0, it is preferable that n+m ranges from 0 to 4, and particularly preferable that it gives 2; and when h=1, preferable range is from 0 to 2.

The mold lubricant, lubricant or slipping agent is used, if it is solid, in a form such as 1) water-dispersion dispersed together with water soluble polymer such as polyvinylalcohol and the like or a dispersing agent such as various kinds of surfactant by known dispersing equipment such as a homegenizer, a dissolver, a sand mill or the like; 2) emulsified material emulsified after being dissolved in a solvent together with a dispersing agent such as a water-soluble polymer, various kinds of surfactant or the like by a known emulsifying apparatus such as a homegenizer, a dissolver, a colloid mill or the like.

The mold lubricant, lubricant or slipping agent is used, if it is fluid, to form the above-mentioned emulsified material. The average particle diameter of the emulsified material ranges preferably from 0.1 to 5.0 μm, and more preferably from 0.1 to 2 μm. The average particle diameter mentioned here means 50% average particle diameter measured by the laser diffraction particle size distribution measurement equipment LA700 manufactured by Horiba Ltd. at the transmittance of 75+/−1%.

When the mold lubricant, lubricant or slipping agent is a hydrophobic organic substance, it is preferable to use it by emulsifying a solution of an organic solvent in which it is dissolved. When the mold lubricant or the like is used as an emulsified material, a water-insoluble particle exists in the protective layer, as a drop particle containing it.

As the surface gloss-controlling agent and matting agent, a starch particle, a fine particle of organic resin such as polymethylmethacrylate, inorganic pigment and the like are used. They are used as dispersed materials similar to the above-described pigment that is used to prevent sticking.

Binder:

From the viewpoint of making the transparency of the protective layer higher, polyvinyl alcohol, carboxy-modified polyvinyl alcohol, silica-modified polyvinyl alcohol and the like are preferred as the binder.

Miscellaneous Ingredients:

The protective layer may include a known hardener.

In order to make the protective layer form evenly on the thermal recording layer or intermediate layer, it is preferable to add surfactant to a coating liquid for the protection layer formation. As the surfactant, alkali metal sulfosuccinate series, fluorine-containing surfactants and the like can be listed. Specifically, sodium salt or ammonium di-(2-ethylhexyl)sulfosuccinate, sodium salt or ammonium di-(n-hexyl)sulfosuccinate and the like can be listed.

In addition, surfactant, a fine particle of metal oxide, inorganic electrolyte, polymer electrolyte or the like may be added to the protective layer for the purpose of antistatic properties of the thermal recording material.

The protective layer may have a single layer structure or a laminate structure of two or more layers. The dry spread of the protective layer is preferably 0.2 to 7 g/m$^2$, and more preferably 1 to 4 g/m$^2$.

Miscellaneous Layers:

The thermal recording material of the invention can be provided on a support with an intermediate layer, an undercoating layer, an ultraviolet light filtering layer, anti-light reflection layer or the like as a miscellaneous layer.

Undercoating Layer:

In the thermal recording material of the invention, for the purpose of preventing the thermal recording layer from being stripped from the support, it is preferred to provide an undercoating layer on the support before coating the thermal recording layer or light anti-reflection layer containing microcapsule and the like. As the undercoating layer, acrylic ester copolymer, polyvinylidene chloride, SBR, hydrophilic polyester and the like can be used. When forming the thermal recording layer on the undercoating layer, sometimes the undercoating layer is swelled with water contained in the coating solution for the thermal recording layer resulting in deteriorating quality of the image to be recorded on the thermal recording layer. Therefore, it is preferred to harden the undercoating layer by using a hardener such as dialdehydes including glutaric aldehyde, 2,3-dihydroxy-1,4-dioxane, boric acid and the like. Suitable addition amounts of these hardeners can be selected in accordance with the desired degree of hardness ranging from 0.20% to 3.0% by weight depending on the weight of the undercoating material. Thickness of the undercoating layer is preferably about 0.05 to 0.5 μm.

When coating the thermal recording layer on the undercoating layer, sometimes the undercoating layer is swelled with water contained in the coating solution for the thermal recording layer, resulting in deteriorated quality of the image to be recorded on the thermal recording layer. Therefore, it is preferred to harden the undercoating layer by using a hardener such as dialdehydes including glutaric aldehyde, 2,3-dihydroxy-1,4-dioxane and the like and boric acid and the like. Addition amount of these hardeners can be selected in accordance with desired hardened degree in the range from 0.20 to 3.0% by weight depending on mass of the undercoating material.

Light Blocking Layer (Ultraviolet Light-Filtering Layer):

In the thermal recording material of the invention, a light-blocking layer may be provided for the purpose of prevention of color degradation due to light and staining of nonimage areas. The light-blocking layer is composed of an ultraviolet absorber uniformly dispersed in a binder. By effective absorption of ultraviolet light by the uniformly dispersed ultraviolet absorber, change in color of nonimage areas and change in color or color degradation of image areas are prevented. As a production method of the light-blocking layer, compounds to be used and the like, in addition to ultraviolet absorbers such as benzotriazole series, benzophenone series, hindered amine series and the like, those described in Japanese Patent Application Laid-open No. 4-197778 can be utilized.

Light Aanti-Reflection Layer:

On the back side of the support opposite to the side on which the thermal recording layer is coated, it is possible to provide a light anti-reflection layer containing fine particles with average particle diameter ranging from 1 to 20 μm, preferably from 1 to 10 μm.

By coating of the light anti-reflection layer, it is preferable to reduce the glossiness, which is measured at an incident angle of 20 degree, to the level of not more than 50%, and more preferable to the level of not more than 30%.

The fine particles to be contained in the light anti-reflection layer are, in addition to fine particles such as starch derived from barley, wheat, corn, rice, beans and the like, cellulose fiber, polystyrene resin, epoxy resin, polyurethane resin, urea formalin resin, poly (metha) acrylate resin, copolymer resins such as vinyl chloride, vinyl acetate and the like, fine particles of synthetic polymer such as polyolefin and the like, and fine particles of inorganic materials such as calcium carbonate, titanium oxide, kaolin, smectite clay, aluminum hydroxide, silica, zinc oxide and the like.

One of them may be used independently or two or more of them may be used together. From the viewpoint of improving transparency of the thermal recording material, it is preferable that they are material in fine particles with a refraction factor of 1.45 to 1.75.

Support:

For the purpose of obtaining a transparent thermal recording material, in the thermal recording material of the invention, it is preferable to use a transparent support. As the transparent support, polyester films such as polyethylene telephthalate, polybutylene telephthalate and the like, and synthetic polymer films such as cellulose triacetate film, polyolefin films made of polypropylene and polyethylene and the like. They may be used independently or in a laminate.

Thickness of the synthetic polymer film is preferably 25 to 250 μm, and more preferably 50 to 200 μ/m.

Further, the synthetic polymer film may be colored in an arbitrary hue. As a method of coloring the polymer film, methods such as mixing a colorant to the resin before forming the resin film then forming the film; a method of coating a coating liquid prepared by dissolving a colorant into a suitable solvent on a colorless and transparent resin film with known coating methods such as, for example, a gravure coating method, a roller coating method, a wire coating method and the like can be listed. Among them, films manufactured by the steps of forming a polyester resin such as polyethylene telephthalate or polyethylene naphthalate, which is mixed with blue colorant, into a film, then performing such processing as a heat-resistant, drawing and anti-static processing are preferable.

Especially, when the transparent thermal recording material of the invention is observed on a Schaukasten viewer from the support side, sometimes the image may become illegible due to ghost generated by Schaukasten ray transmits through the transparent non-image area.

In order to avoid this phenomenon, it is particularly preferable to use a synthetic polymer film that is colored in blue within the square formed by four points A (x=0.2805, y=0.3005), B (x=0.2820, y=0.2970), C (x=0.2885, y=0.3015) and D (x=0.2870, y=0.3040) on the chromaticity coordinates.

Also on the side of the support where the thermal recording layer is not provided, a back-coating layer may be provided.

Production Method of the Thermal Recording Material:

Hereinafter, a production method of the thermal recording material of the invention will be described.

The production method of the thermal recording material of the invention includes the steps of forming a thermal recording layer on a support by coating a coating liquid for forming the thermal recording layer, forming a protective layer by coating a coating liquid for forming the protective layer on the thermal recording layer, and forming other layers if necessary.

Here, the thermal recording layer and the protective layer may be formed simultaneously, and in this case, the coating liquids for the thermal recording layer and protective layer are being multi-coated on the support to simultaneously form the thermal recording layer and, on the layer, the protective layer.

As the support to be used here, the support that is used in the thermal recording material of the invention, which has already been described, can be used. Further, as the coating liquid for forming the thermal recording layer, the above-described coating liquid for forming the thermal recording layer can be used; and as the coating liquid for forming the protective layer, also the above-described coating liquid for forming the protective layer that contains pigment and binder can be used.

Furthermore, as above-described miscellaneous layers, miscellaneous layers such as above-described intermediate layer, undercoating layer and the like can be listed.

The miscellaneous layers are the other layers such as the intermediate layer or the undercoating layer.

In the production method of the invention, the thermal recording layer, the intermediate layer, the protective layer and the like on the support, known coating methods are utilized to form sequentially the under coating layer, such as a blade coating method, an air knife coating method, a gravure coating method, a roll coating method, a spray coating method, a dip coating method and a bar coating method and the like. Further, as a method of simultaneously multi-coating multiple layers, an extrusion die method can be listed.

More specifically, various kinds of coating operations are utilized including extrusion coating, slide coating, curtain coating, dip coating, knife coating, flow coating, or extrusion coating using a kind of hopper described in U.S. Pat. No. 2,681,294. Among them, the extrusion coating or the slide coating described on the pages 399 to 536 of "*LIQUID FILM COATING*" (by Stephen F. Kistler and Petert M. Schweizer, published by CHAPMAN & HALL in 1997) are preferably used, and use of the slide coating is particularly preferable. Examples of the shape of the slide coater used for slide coating are described in the FIG. 11*b*.1 on the page 427 of the book. Also, if desired, two or more layers can be coated simultaneously by the methods described on the pages 399 to 536 of the book and by the methods described in U.S. Pat. No. 2,761,791 and British Patent No. 837,095.

In a drying process, by controlling a wet membrane surface temperature at not higher than about 35° C. (there are small differences in the setting temperatures, depending on kinds of gelatin, however, about 35° C. is the setting temperature of gelatin in general), it is possible to avoid mixing of adjacent layers utilizing setting properties of gelatin.

Thermal Head:

A thermal head used in the thermal recording process of the invention is provided with a protective layer that is set up to the heating element having a heat-resistant element and electrodes on the glazed layer by using a known coating equipment so that the carbon ratio of the top layer contacting with the thermal recording material would be no less than 90%. The head protective layer may be composed of two or more layers, and in this case, the carbon ratio of at least the top layer is required to be not less than 90%.

EXAMPLES

Hereinafter, the invention will be specifically described by examples, however it is not limited to these examples. In the following description, "%" means "% by weight".

Preparation of the Coating Liquid for a Protective Layer

Preparation of a Pigment Dispersion Liquid for the Protective Layer

After adding 30 g of aluminum hydroxide treated by stearic acid (trade name: Hydilite H42S, manufactured by Showa Denko Co., Ltd) as a pigment into the 110 g of water and agitating it for three hours, 0.8 g of a dispersion auxiliary agent (trade name: Poise 532A, manufactured by Kao Corporation), 30 g of a 10% by weight polyvinyl alcohol aqueous solution (trade name: PVA105, manufactured by Kuraray Co., Ltd.) and 10 g of an aqueous solution of 2% by weight of the compound represented by the following structural formula [100] are added and dispersed with a sand mill resulting in a pigment dispersion liquid of the average particle diameter of 0.30 μm for the protective layer.

Here, "the average particle diameter" means the average particle diameter of pigment particles corresponding to 50% volume of the entire pigment determined according to following steps of: dispersing pigment to be used in water under circumstance where the dispersion auxiliary agent coexists; adding water to the pigment dispersed substance just after dispersion to be diluted to 0.5% by weight resulting in a test fluid; dropping the test fluid into hot water at 40° C. so that its optical transmittance becomes 75+/−1%; being treated with supersonic waves for 30 seconds; and being measured with a laser particle distribution measurement equipment (trade name: LA700, manufactured by Horiba Ltd.). All of "the average particle diameter" indicated hereinafter mean the average particle diameter measured using the same method.

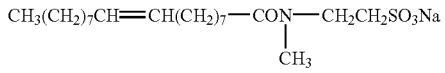

[100]

Preparation of a Coating Solution for a Protective Layer

The following were mixed to 65 g of water to obtain a coating liquid for a protective layer:

| | |
|---|---|
| 8% by weight polyvinyl alcohol aqueous solution (trade name: PVA124C, manufactured by Kuraray Co., Ltd) | 90 g |
| 20.5% by weight zinc stearate dispersion material (trade name: F-115, manufactured by Chukyo Oil and Fat Co., Ltd.) | 5.5 g |
| 21.5% by weight amide stearate compound (trade name: G-270, manufactured by Chukyo Oil and Fat Co., Ltd.) | 3.8 g |
| 18.0% by weight stearic acid (trade name: Celozole 920, manufactured by Chukyo Oil and Fat Co., Ltd.) | 2.8 g |
| 4% boric acid aqueous solution | 10 g |
| The dispersion fluid of the pigment for the protective layer (18% by weight) | 70 g |
| 35% by weight silicon oil water dispersion fluid (polydimethyl siloxane, trade name: BY22-840, manufactured by Toray Dow Corning Co., Ltd) | 4.7 g |
| 10% by weight sodium dodecylbenzen sufonate aqueous solution | 6.5 g |
| Ammonium di-2-ethylhexylsulfosuccinate (75% liquid of Nissan electole SAL1 (trade name): manufactured by NOF Corporation) | 3.28 g |
| 6% by weight styrene-maleic acid copolymer ammonium salt aqueous solution (trade name: Polymalon 385, manufactured by Arakawa Chemicals Co., Ltd.) | 17.5 g |
| 20% colloidal silica (trade name: Snowtex, manufactured by Nissan Chemical Industries Co., Ltd.) | 14 g |
| Fluorobetaine surfactant (trade name: Surflone S131S, manufactured by Seimi Chemicals Co., Ltd) | 16 g |
| Alkyl phosphate ester (trade name: Prisurf A217, manufactured by Daiichi Kogyo Phamaceutical Col., Ltd) | 1.1 g |
| 2% acetic acid | 8 g. |

Preparation of a Coating Liquid for a Thermal Recording Layer

As shown below, a microcapsule liquid and a developer emulsion-dispersion material liquid were prepared.

Preparation of Microcapsule A

For a coloring agent, the following compounds were added to 24.3 g of ethyl acetate, and then the resultant was heated up to 70° C. to dissolve them and then cooled down to 45° C.:

| | |
|---|---|
| Compound represented by the structural formula [201] | 11.7 g |
| Compound represented by the structural formula [202] | 1.5 g |
| Compound represented by the structural formula [203] | 2.2 g |
| Compound represented by the structural formula [204] | 5.65 g |
| Compound represented by the structural formula [205] | 1.2 g |
| Compound represented by the structural formula [206] | 1.1 g |
| Compound represented by the structural formula [207] | 0.57 g. |

-continued

[201]

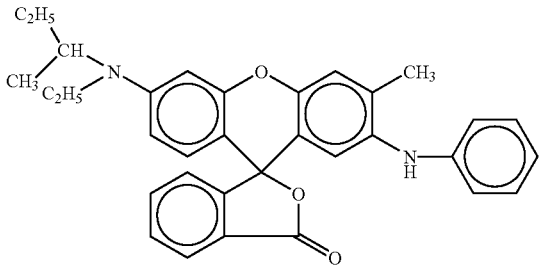

[202]

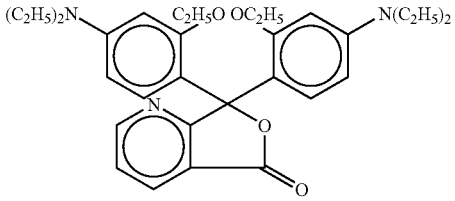

[203]

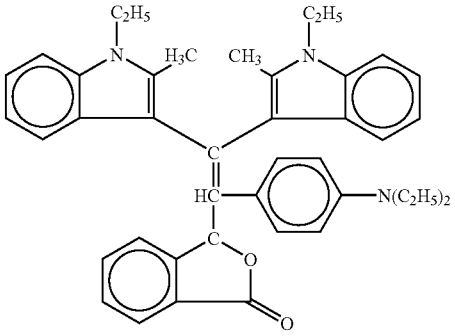

[204]

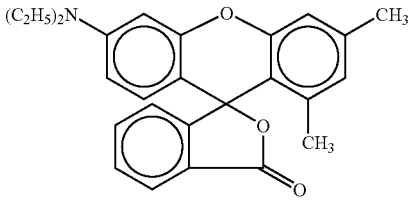

[205]

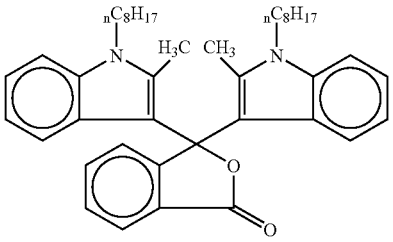

[206]

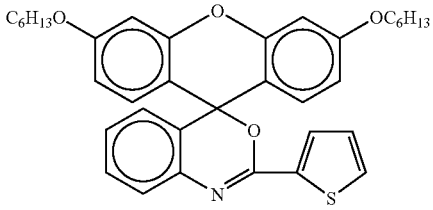

-continued

[207]

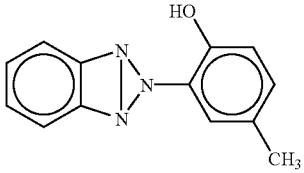

To this, capsule wall materials (namely, 13.1 g of Takenate D140N (trade name, manufactured by Takeda Chemical Industrial Co., Ltd.) and 2.3 g of Banock D750 (trade name, manufactured by Dainippon Ink and Chemicals Inc.)) were added and mixed together.

After adding this solution to an aqueous phase in which 48 g of 8% by weight of polyvinyl alcohol aqueous solution (trade name: PVA217 C, manufactured by Kuraray Co., Ltd.) were added to 16 g of water, it was emulsified at 15000 rpm by using Ace Homogenizer (trade name, manufactured by Nippon Seiki Co., Ltd.) for 5 minutes. After adding 110 g of water and 11.0 g of tetraethylenepentamine to the obtained emulsified liquid, a microencapsulation reaction was performed for 4 hours at 60° C. to prepare a microcapsulated coating liquid with the average particle diameter of 0.35 μm (density of solid content 23%).

Preparation of microcapsule B

After adding compounds represented by following structural formula to 21 g of ethyl acetate, then the resultant was heated up to 70° C. to dissolve them, then cooled down to 35° C.:

| | |
|---|---|
| Compound represented by the structural formula [201] | 12.2 g |
| Compound represented by the structural formula [202] | 1.6 g |
| Compound represented by the structural formula [203] | 2.4 g |
| Compound represented by the structural formula [204] | 3.3 g |
| Compound represented by the structural formula [205] | 1.5 g |
| Compound represented by the structural formula [206] | 0.2 g |
| Compound represented by the structural formula [207] | 0.5 g. |

After adding 0.5 g of n-butanol, capsel wall materials (14.1 g of Takenate D127N (trade name) and 2.5 g of Takenate D110N, both are trade names, and manufactured by Takeda Chemical Industrial Co., Ltd.) to the solution, the mixture was kept at 35° C. for 40 minutes.

After adding this solution to an aqueous phase in which 48.1 g of 8% by weight of polyvinyl alcohol aqueous solution (trade name: PVA217 C, manufactured by Kuraray Co., Ltd.) were added to 16.6 g of water, it was emulsified at 15000 rpm by using Ace Homogenizer (manufactured by Nippon Seiki Co., Ltd.) for 5 minutes. After adding 112 g of water and 0.9 g of tetraethylenepentamine to the obtained emulsified liquid, microencapsulation reaction was performed for 4 hours at 60° C. to prepare a microcapsulated coating liquid with the average particle diameter of 0.35 μm (density of solid content 24%).

| Preparation of an emulsion-dispersed liquid of developer As developer, | |
|---|---|
| Compound represented by the structural formula [301] | 6.7 g |
| Compound represented by the structural formula [302] | 8.0 g |
| Compound represented by the structural formula [303] | 5.8 g |

-continued

| Preparation of an emulsion-dispersed liquid of developer As developer, | |
|---|---|
| Compound represented by the structural formula [304] | 1.5 g |
| Compound represented by the structural formula [305] | 2.2 g |
| Compound represented by the structural formula [306] | 0.8 g |
| Compound represented by the structural formula [307] | 4.3 g |

were added together with 11.0 g of tricrezilphosphate and 0.5 g of diethyl maleate to 16.5 g of ethyl acetate. Then the mixture was heated up to 70° C. to dissolve them.

[301]

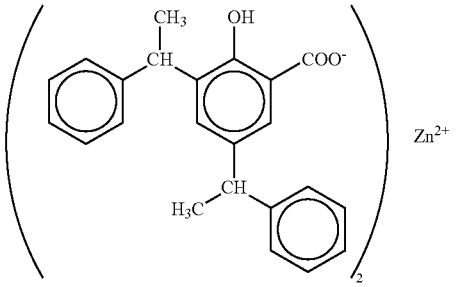

[302]

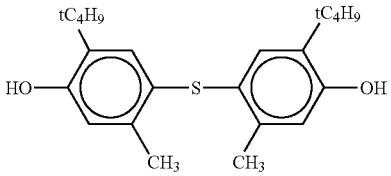

[303]

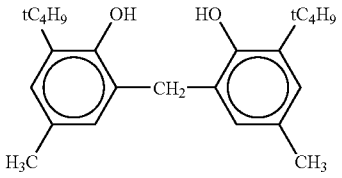

[304]

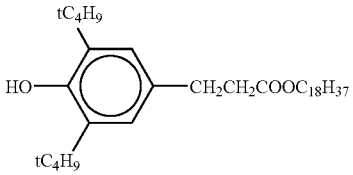

[305]

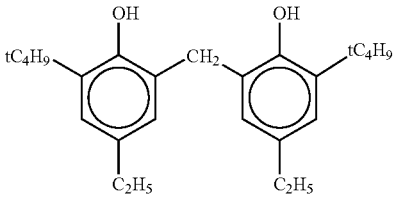

[306]

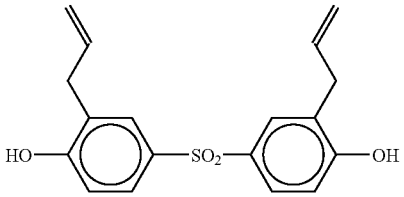

-continued

[307]

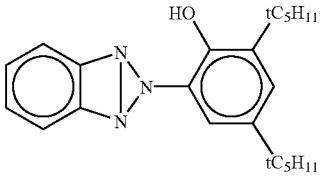

After adding this solution to a aqueous phase in which 57 g of 8% by weight of polyvinyl alcohol aqueous solution (trade name: PVA217C, manufactured by Kuraray Co. Ltd.), 20 g of 15% by weight of polyvinyl alcohol aqueous solution (trade name: PVA205C, manufactured by Kuraray Co. Ltd.), and 11.5 g of 2% by weight of aqueous solution of compound represented by the following structural formula [401] and compound represented by the following structural formula [402] were all mixed together.

[401]

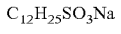

[402]

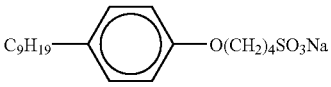

Then the mixture was emulsified at 10000 rpm by using Ace Homogenizer (trade name, manufactured by Nippon Seiki Co., Ltd.) so that the average particle diameter became 0.7 μm to obtain an emulsion-dispersed liquid of the developer (density of the solid content 22%).

Preparation of Coating Solution A for a Thermal Recording Layer 12 g of the microcapsule A, 2.5 g of the microcapsule B, 50 g of the emulsion-dispersed liquid of the developer, 0.7 g of 50% by weight aqueous solution of the compound represented by the following structural formula [403], and 1.8 g of colloidal silica (trade name: Snow Tex, manufactured by Nissan Chemical Industries Co., Ltd.) were mixed to prepare a coating liquid A for the thermal recording layer.

[403]

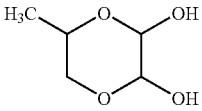

Preparation of a Coating Liquid B for the Thermal Recording Layer

The followings were mixed to prepare a coating liquid B for the thermal recording layer:

| | |
|---|---|
| Microcapsule A | 2.3 g |
| Microcapsule B | 6.6 g |
| Emulsion-dispersed material of developer | 33 g |
| Colloidal silica (trade name: Snowtex, manufactured by Nissan Chemical Industries Co., Ltd.) | 1.5 g |

-continued

| | |
|---|---|
| 50% by weight aqueous solution of the compound represented by the structural formula [403] | 0.4 g. |

Preparation of a Coating Liquid A for an Intermediate Layer

After dissolving 1 kg of lime-treated gelatin into 7848 g of water, 137 g of 5% solution (mixed solvent of water/methanol=1/1 by volume) of sodium di-2-ethylhexylsulfosuccinate (trade name: Nissan Rapizol B90, manufactured by NOF Corporation) was added to prepare a coating solution A for the intermediate layer.

Preparation of a Coating Liquid C for the Thermal Recording Layer 35 g of 6% by weight aqueous solution of PVA (trade name: PVA124C, manufactured by Kuraray Co., Ltd.), 2 g of 2% aqueous solution of the compound represented by the following structural formula [404], 0.5 g of Microcapsule A were added into water to prepare a coating liquid for the thermal recording layer.

[404]

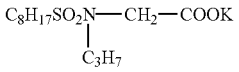

Preparation of a Coating Liquid for a BC Layer (Back Layer)

The followings were mixed with water to obtain 62.77 liters in total:

3,761 g of emulsified material of ultraviolet absorber containing 1 kg of lime-treated gelatin, 757 g of gelatin dispersion containing 12% by weight of spherical PMMA matting agent having the average diameter of 5.7 μm, and compound represented by the construction formula [501] to [505] (content of each ultraviolet absorber in 1 kg of the emulsion was as follows:

| | |
|---|---|
| Compound represented by the structural formula [501] | 9.8 g |
| Compound represented by the structural formula [502] | 8.4 g |
| Compound represented by the structural formula [503] | 9.8 g |
| Compound represented by the structural formula [504] | 13.9 g |
| Compound represented by the structural formula [505] | 29.3 g) |
| 1,2-benzisothiazoline-3-one | 1.75 g |
| poly(sodium p-vinylbenzen sulfonate) (molecular weigh was about 400,000) | 64.2 g |
| Compound represented by the structural formula [506] | 10.0 g |
| 20% liquid of polyethyl acrylate Latex | 3,180 ml |
| N,N-ethylene-bis(vinylsulfonylacetamide) | 75.0 g |
| 1,3-bis(vinylsulfonylacetamide) propane | 25.0 g |

[501]

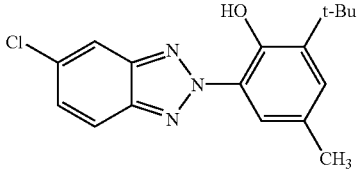

[502]

-continued

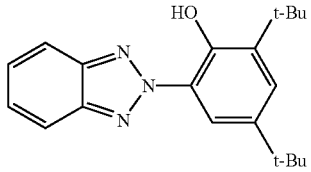

[503]

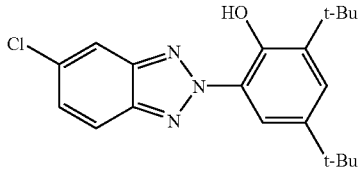

[504]

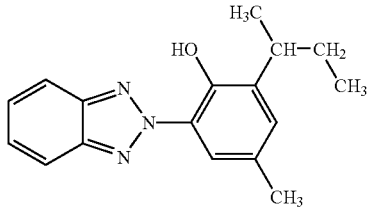

[505]

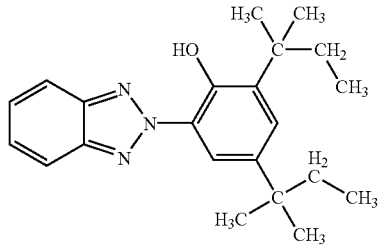

[506]

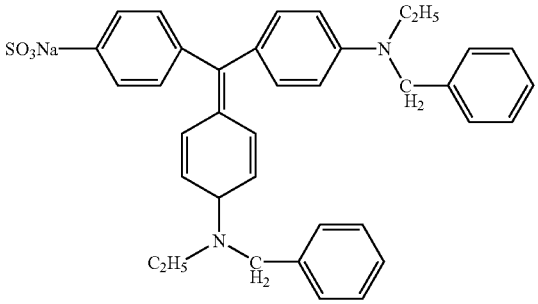

Preparation of a Coating Solution for a BPC Layer (Back Protective Layer)

Two thousand g of an emulsified material of the ultraviolet absorber consisting of 1 kg of lime-treated gelatin and 2000 g of gelatin dispersion containing 15% by weight of spherical PMMA matting agent having the average particle diameter of 0.70 μm, 1,268 ml of methanol, 1.75 g of 1,2-benzisothiazoline-3-one, 64.4 g of sodium polyacrylate (molecular weight was about 100 thousands), 54.0 g of poly(sodium p-vinylbenzen sulfonate) (molecular weight was about 400 thousands), 25.2 g of sodium p-t-octhylphenoxy polyoxyethylene-ethylsulfonate, 5.3 g of sodium N-propyl-N-polyoxyethylene-perfluorooctane sulfonicamide butylsulfonate and 7.1 g of potassium perfluorooctane sulfonate were mixed. After adjusting pH of the mixture to 7.0 by sodium hydroxide, water was added to it to result in the total volume of 66.79 liters.

The coating solutions for the BC layer and the BPC layer were simultaneously multi-coated by a slide bead method on a support made of transparent PET colored in blue having color coordinates X=0.2850 and Y=0.2995 defined by the method described in JIS-Z8701, wherein the coating solution for the BC layer was applied nearer to the support than that for the BPC layer and coating amounts were 44.0 ml/m$^2$ and 18.5 ml/m$^2$ respectively, and then dried. The conditions of coating and drying were as follows.

The coating speed was set as 160 m/mim; clearance between the head of the coating die and the support was set as 0.10 to 0.30 mm; pressure in a decompression chamber was set lower than atmospheric pressure by 196 to 882 Pa. Electric charges on the support were eliminated by use of ionic wind before the coating.

In a consecutive chilling zone, the coated layers were cooled with wind of which dry-bulb temperature was 10 to 20° C.; then dried, while being conveyed without any contact, by use of a helical no-contact type drying apparatus with dried wind whose dry-bulb and wet-bulb temperatures were 23 to 45° C. and 15 to 21° C., respectively.

Production of a Thermal Recording Material

On the surface of the support opposite to the surface on which the BC layer was coated, respective coating solutions for the thermal recording layer A, the thermal recording layer B, the intermediate layer A, the thermal recording layer C and the protective layer were simultaneously multi-coated in this order from the support by use of the slide bead method and dried, wherein respective coating amounts were 50, 20, 18.2, 25, and 25 ml/m$^2$. Thus, the transparent thermal recording material of the invention comprising the thermal recording layer A, the thermal recording layer B, the intermediate layer A, the thermal recording layer C and the protective layer on the support in this order. Conditions of coating and drying were as follows.

Coating speed was set at 160 m/mim; clearance between the head of the coating die and the support was set at 0.10 to 0.30 mm; pressure in a decompression chamber was set lower than the atmospheric pressure by 196 to 882 Pa. Electric charges on the support were eliminated by use of ionic wind before the coating.

The coated material was subjected to an initial drying in a consecutive first drying zone by use of wind whose dry-bulb temperature and dew point were 40 to 60° C. and 0° C., respectively, and having a wind speed of not more than 5 m/sec at the membrane surface; then dried, while being conveyed without any contact, by use of a helical no contact type drying apparatus with dried wind whose dry-bulb temperature was 23 to 45° C. and relative humidity was 20 to 70% RH, and having a wind speed of 15 to 25 m/sec while regulating the membrane surface temperature at 18 to 23° C.

Here, in solid components of the protective layer, the content of ammonium di-2-ethylhexyl sulfosuccinate is 7.2%.

Images were recorded on the obtained thermal recording material by a thermal head (trade name: KGT, 260-12MPH8, manufactured by Kyocera Corporation) at head pressure of 10 kg/cm$^2$ and recording energy of 85 mJ/mm$^2$. After the recording, following evaluations were conducted. Results are shown in Table 1.

Chemical Resistance A

After images were printed on the sample by using a Kyocera printing test device, the sample was sandwiched between a wrapping sheet for kitchen use (polyvinyl chloride wrapping sheet) and left for 30 days at 23° C./65% with relative humidity. Changes were checked by visual observation.

Chemical Resistance B

After images were printed on the sample by using the Kyocera printing test device, the sample was sandwiched between wrapping sheet for kitchen use (polyvinyl chloride wrapping sheet) and left for 7 days at 40° C./65% with relative humidity while being pressured between glass sheets. Changes were checked by visual observation.

Evaluation Rank

AA: There is no change at all

A: There is no change in color or no deterioration in color, but some kind of change is recognized.

B: There is a slight change in color or slight deterioration in color, but they do not adversely effect the printings to be read.

C: There is change and deterioration in color as well as generation of bleeding, but it is still possible to read the printings.

D: There is change and deterioration in color and generation of bleeding, further it is difficult to read the printings, and therefore there may be a material disadvantage from a practical standpoint.

Evaluation Method of Surface Irregularity Due to Wind

1) The thermal recording material was left in an oven at 120° C. for 4 minutes to make color develop evenly and was checked on uneven development by visual observation.

2) Color was developed on the whole surface of the thermal recording material of B4 size by the thermal head (trade name: KGT, 260-12MPH8, manufactured by Kyocera Corporation) while controlling head pressure at 980 kPa (10 kg/cm$^2$) and recording energy so that transmission density became OD 1.2. Then, the sample was checked on a Schaukasten by visual observation. Transmission density was measured by a transmission density measurement equipment manufactured by Macbeth (trade name: RD912 type) under the visual filter condition.

Evaluation was Made Based on Following Ranks.

AA: There is no irregularity in color at all realizing uniform quality.

A: It is almost even, but some kind of irregularity is recognized depending on observation condition.

B: There is a slight irregularity, but the density difference is small and they will not adversely effect on the image.

C: There is obvious irregularity, but it is still acceptable for practical use.

D There is definite irregularity and therefore there may be a material disadvantage from a practical standpoint.

Example 2

A thermal recording material was obtained in the same manner as in Example 1 except for changing the position of the intermediate layer A to the position between the thermal recording layers A and B.

Example 3

A thermal recording material was obtained in the same manner as in Example 1 except for removing the intermediate layer A, replacing the coating solution for C with a coating solution D described below and changing the coating amount to 19 ml/m$^2$.

Coating Solution for a Thermal Recording Layer D

One kg of lime-treated gelatin was added with 7848 g of water and dissolved. To the solution, 137 g of 5% solution (water/methanol 1/1 by volume mixed solvent) of sodium di-2-ethylhexy sulfonate (trade name: Nissan Rapizol B90, manufactured by NOF Corporation) was added and further 240 g of microcapsule A was added to prepare a coating liquid for a thermal recording material D.

Comparative Example 1

A thermal recording material was obtained in the same manner as in Example 1 except for removing the intermediate layer.

Comparative Example 2

A thermal recording material was obtained in the same manner as in Example 1 except for replacing the intermediate layer A with an intermediate layer B formed by using a coating solution for an intermediate layer B shown bellow in a coating amount of 33.3 ml/m$^2$.

Preparing a Coating Liquid for a Intermediate Layer B

One kg of PVA124C (trade name, manufactured by Kuraray Co., Ltd.) was added with 15667 g of water and dissolved. To the solution, 137 g of 5% solution (water/methanol 1/1 by volume mixed solvent) of sodium di-2-ethylhexy sulfonate (trade name: Nissan Rapizol B90, manufactured by NOF Corporation) was added to prepare a coating liquid for an intermediate layer B.

For Examples 2 and 3, as well as Comparative examples 1 and 2, the same evaluations as Example 1 were performed. Results are shown in Table 1.

TABLE 1

| | Evaluation of Irregularity due to Wind | | Elasticizer Resistance | | |
|---|---|---|---|---|---|
| | Uniformly Developed Color in Oven | TH Printing | Chemical Resistance A | Chemical Resistance B | Structure of the Thermal Recording material |
| Example 1 | B | A | AA | AA | Intermediate layer A between thermal recording layers B and C |
| Example 2 | A | A | AA | A | Intermediate layer A between thermal recording layers A and B |
| Example 3 | A | AA | AA | A | Thermal recording layer D contains gelatin as a binder |
| Comparative Example 1 | D | D | A | B | No intermediate layer |
| Comparative Example 2 | D | D | A | B | Intermediate layer B between thermal recording layers A and B contains PVA binder |

In the thermal recording material of the invention, since the intermediate layer contains gelatin, when plural layers are formed by coating respective coating liquids for the plural layers on the support and drying, both in the methods of sequential coating and drying of the plural layers and simultaneous multi-coating and drying of the plural layers using a extrusion die system, interflow between adjacent two layers are effectively prevented to result in good surface condition of the obtained thermal recording material. Consequently, the thermal recording material can be obtained that enables to image formation with high quality. Further, if it is dried with a high-speed wind, its surface does not show any deterioration and production efficiency is improved.

What is claimed is:

1. A thermal recording material comprising a transparent support having disposed thereon a plurality of layers including at least a thermal recording layer, characterized in that an intermediate layer comprising a single binder is disposed between at least one pair of two mutually adjacent layers including at least one thermal recording layer;

wherein one of the plurality of layers and the intermediate layer comprises a phenolic compound; the binder contained in the intermediate layer is gelatin; and a coating liquid for forming the layer comprising the phenolic compound comprises an emulsified liquid of the phenolic compound using polyvinyl alcohol as a dispersing agent, said emulsified liquid being prepared by emulsifying a low molecular organic solvent solution of the phenolic compound.

2. The thermal recording material according to claim 1, characterized in that each layer adjacent to the intermediate layer comprises polyvinyl alcohol as a main component of a binder.

3. The thermal recording material according to claim 1, characterized in that the support comprises a polymer film.

4. The thermal recording material according to claim 1, wherein the transparent support is a polyethylene telephthalate film.

5. A method of producing a thermal recording material comprising the step of forming on a transparent support plural layers including at least a thermal recording layer and an intermediate layer that comprises a single binder that is gelatin, and is disposed between at least one pair of two mutually adjacent layers of the plurality of layers including at least one thermal recording layer, by coating on the support respective coating liquids for forming the layers and drying the layers, characterized in that the intermediate layer is dried while controlling a wet membrane surface temperature of no higher than 35° C.;

wherein one of the plurality of layers and the intermediate layer comprises a phenolic compound; and a coating liquid for forming the layer comprising the phenolic compound comprises an emulsified liquid of the phenolic compound using polyvinyl alcohol as a dispersing agent, said emulsified liquid being prepared by emulsifying a low molecular organic solvent solution of the phenolic compound.

6. The method according to claim 5, characterized in that each layer adjacent to the intermediate layer comprises polyvinyl alcohol as a main component of a binder.

7. The method according to claim 5, characterized in that the support comprises a polymer film.

8. The method according to claim 5, characterized in that all of the plurality of layers and the intermediate layer are simultaneously multi-coated by an extrusion die method.

9. The method according to claim 5, wherein the transparent support is a polyester film or a synthetic polymer film.

10. The method according to claim 5, wherein the transparent support is a polyethylene telephthalate film.

11. A method of manufacturing a thermal recording material comprising a transparent support having disposed thereon a plurality of layers including at least a thermal recording layer and at least an intermediate layer comprising a single binder that is gelatin, the method comprising, forming at least one of the plurality of layers and the intermediate layer by coating a liquid that is prepared by emulsifying a low molecular organic solvent solution of a phenolic compound using polyvinyl alcohol as a dispersing agent, wherein the intermediate layer is disposed between at least one pair of two mutually adjacent layers including at least one thermal recording layer.

12. The thermal recording material according to claim 1, wherein the transparent support is a polyester film or a synthetic polymer film.

13. The method according to claim 11, wherein the transparent support is a polyester film or a synthetic polymer film.

14. The method according to claim 11, wherein the transparent support is a polyethylene telephthalate film.

* * * * *